United States Patent [19]

Stearns

[11] 4,305,729

[45] Dec. 15, 1981

[54] CARBON SLURRY FUELS

[75] Inventor: Richard S. Stearns, West Chester, Pa.

[73] Assignee: Suntech, Inc., Philadelphia, Pa.

[21] Appl. No.: 237,224

[22] Filed: Feb. 23, 1981

[51] Int. Cl.[3] ..... C10L 1/32

[52] U.S. Cl. ..... 44/51; 44/63; 44/67; 44/76

[58] Field of Search ..... 44/51, 63, 67, 76

[56] References Cited

U.S. PATENT DOCUMENTS

| | | | |
|---|---|---|---|
| 1,390,231 | 9/1921 | Bates | 44/51 |
| 2,231,513 | 2/1941 | Stillman | 44/51 |
| 2,590,733 | 3/1952 | Stillman | 44/51 |
| 3,764,547 | 10/1973 | Schlinger et al. | 44/51 |

OTHER PUBLICATIONS

Chemical Week; Oct. 29, 1980; p. 79.

D. J. Jeffrey et al.; (AICHE) Journal; vol. 22, No. 3; May 1976; p. 417.

*Primary Examiner*—Jacqueline V. Howard

*Attorney, Agent, or Firm*—J. Edward Hess; Donald R. Johnson; Paul Lipsitz

[57] ABSTRACT

A liquid composition suitable as a high performance fuel and having improved rheological and stability properties comprising a liquid hydrocarbon having carbon particles dispersed therein of at least two disparate particle sizes, one of said carbon particles having an average particle diameter of from about 300 to about 350 mu and the other particle having an average particle diameter of about 20 to about 50 mu, the carbon particles of the smaller size black being present in an amount between about 20 and about 25 weight percent of the total black percent.

7 Claims, No Drawings

CARBON SLURRY FUELS

It is known that the volumetric net heat of combustion of liquid fuels can be increased by adding to the liquid finely divided solids such as carbon which have densities substantially greater than that of the liquids themselves and are also capable of being consumed via an oxidation process involving the formation of gases. In making such slurry fuels it is desirable to obtain a liquid product which is pumpable, i.e., it should exhibit a low viscosity, at least under shear, and will have other rheological properties that will enable it to be atomized in a nozzle and burned, say in a ramjet or turbine engine. A particle of high density is important in order to increase the volumetric heat of combustion, or conversely, for a given volumetric heat of combustion a high density particle enables a lower particle concentration to be used resulting in better rheological properties (e.g. a more fluid dispersion). Also, the dispersion of particles in the fuel must also be stable and not settle out over a period of time.

U.S. Pat. No. 2,754,267 discusses this problem to some extent and discloses suspensions of carbon in a fuel oil used for increasing flame radiation where the carbon-containing fuel oil is injected into steel mill furnaces. In the disclosure of this patent carbon blacks are used with a large exposed surface area having monomolecular layers of certain polymers on the surface, the carbon particles being preferably anisometric (i.e., not spherical) and of a particle size diameter of the shortest dimension of less than about 1 micron, preferably 0.02 to 0.8 micron.

It is also known that spherically shaped carbon particles can be dispersed in jet fuels (Final Report; Ramjet Fuels Analysis Supplement, Contract No. Y6E140, Ashland Chemical Company, Research and Development Division, Process Development Section, L. J. Frainier and P. M. Colling). However, as pointed out in this report, a concentration of carbon particles above 40% by weight could not be achieved and such concentrations are below that required to give an effective carbon-slurry fuel.

What is required for an effective carbon-slurry fuel is a liquid slurry which is highly stable, has suitable viscosity characteristics (e.g. will flow properly during use), and which has a high carbon content so that the formulation can yield high thermal energy. Thus, the carbon slurry fuel composition must have properties that are unique with respect to its rheological properties and stability and, therefore, which make it a highly desirable fuel for use in high performance gas turbine engines such as those utilized by manned aircraft, military missiles, or various types of self propelled vehicles such as trucks, military tanks, etc. where there is a premium placed on the heat content of the fuel in terms of BTU/gallon, i.e., volume limited applications. These fuel compositions must be pumpable, which puts constraints on the viscosity, while at the same time exhibiting a high degree of stability with respect to the settling of the dispersed particles over a long time period. In addition the net volumetric heat of combustion expressed as BTU/gallon must be kept as high as possible which requires as high a dispersed carbon content as can be tolerated in the hydrocarbon fuel and still maintain a flowable dispersion under the conditions of shear encountered in fuel transport from the vehicle storage vessel to the combustion chamber. In general, the required heat of combustion for such fuels must be at least about 170,000 BTU per gallon of slurry, preferably equal to or greater than 180,000 BTU/gal.

The addition of appropriate amounts of a medium thermal (MT) black to a fuel will give a composition of high energy, but such a composition is unstable; that is, the particulates will settle out. The use of deflocculants help reduce this instability, but to overcome it satisfactorily so much deflocculant is needed that the heat of combustion is significantly reduced. A high abrasion furnace (HAF) black may also be used in a hydrocarbon to produce a high energy fuel, but in this instance so much is required for about 170,000 BTU per gallon of slurry that the fuel composition becomes very viscous or even gelled and cannot be pumped to the engine.

In accord with this invention a novel slurry fuel composition of high particulate concentration and of satisfactory stability and rheological properties is provided, comprising a liquid hydrocarbon having dispersed therein at least about 50% by weight of the hydrocarbon of carbon particles comprising two disparate particle sizes and wherein one carbon particle has an average particle diameter of from about 300 to about 350 mu and the second carbon particle has an average particle diameter of about 20 mu to about 50 mu, and, of the total black present, between about 20% to about 25% is of the smaller particle size black. A suitable carbon particle having an average particle diameter of from about 300 to about 350 mu is available commercially as medium thermal (MT) black. A high abrasion furnace (HAF) black has an average particle size of from about 20 mu to about 50 mu and is quite suitable as the smaller carbon particle for the invention.

The liquid hydrocarbons employed to make the slurry fuels will be high density fuels having a density of at least about 0.9 and will be conventional jet fuel types such as methylcyclohexane, JP-4, JP-5, JP-9, JP-10, RJ-4, RJ-5, RJ-6 and the like or their mixtures. The technology for making slurry fuels from these materials is well known and will be employed in making the fuels of this invention. In one embodiment of the invention a blend of RJ-5 and JP-10 will be used preferably in a volumetric ratio of about 60:40.

The carbon slurry formulation may and preferably will contain appropriate additives in stabilizing amounts to aid in the dispersing and stabilizing of the suspension. Any one or more of a number of commercial surfactants can be utilized as, for example, succinnimide types, barium sulfonate, calcium sulfonate, imide type pigment dispersants, and the like. For long-term stability, it may be desirable to add an aluminum soap to the dispersion. A preferred agent to impart stability to the suspension is an oligomeric succinnimide containing about 2.3% nitrogen (sold by Edwin Cooper as Hitec E-645 Deflocculant) and is added at a level of from about 5% to about 7.5% of the carbon content of the slurry.

As indicated, both the MT black and the HAF black are well known products readily available commercially and require no special treatment before use in the formulation. In making the carbon slurry fuel of the invention all that is required is to thoroughly mix the ingredients into the hydrocarbon liquid with a high speed mixer or other device to ensure that a well dispersed product is obtained.

The concentration of the carbon in the fuel will be at least about 40% in a high density fuel such as RJ-6 (density = 1.02) and up to about 65% in a high energy fuel having a density of about 0.93 (JP-10). It will be understood, that appropriate milling procedures, use of dispersants and other conventional techniques will be used in preparing the dispersions. A concentration much above 65% by weight, although achievable, will generally be too viscous to be used as a fluid fuel composition.

The fuel composition of the invention will have a stability of at least about 0.6 which is the ratio representing the concentration of black in the upper one ml. in a standard 15 ml. centrifuge tube after centrifuging the composition for eight hours at 2285 RPM (about 1000 G's), divided by the black concentration before centrifugation. This is a very significant unexpected improvement over the stability of 0.06 obtained when MT black is used alone at 50% concentration.

The fuel composition of the invention, when used as fuel for a missile system is readily pumped and atomized, and will be stable over a wide temperature range of from about −65° to about 250° F. It has been determined that the fuel composition containing 20% HAF black has a Haake viscosity of 730 cps at −65° F. and a composition with 25% HAF has a viscosity of 975 cps at that temperature.

In order to further illustrate the invention the following example is given: EXAMPLE To JP-10 fuel there was added various amounts of a medium thermal black (ASTM designation N-990) and a high abrasion furnace black (N-754) and a deflocculant (Hitec E-645) at a concentration of 5% by weight of the carbon black. A high speed mixer (15,000 to 20,000 RPM) was used to mix the ingredients for one hour in a two liter stainless steel flask with cooling provided to maintain the temperature at ambient conditions.

The finished slurry was subjected to measurements of viscosity and stability.

Viscosity was measured on a Brookfield rotating cylinder viscometer at 60 rpm.

Stability was measured by centrifuging 15 ml. of the slurries for eight hours at 2285 rpm (ca 1000 G's) in a laboratory bench top centrifuge and sampling the top 1 ml.

Table I is a summary comparison of various 170,000 BTU/Gal. fuel compositions prepared containing MT and HAF blacks in JP-10 and indicates the superiority of mixtures of MT and HAF blacks in viscosity and stability in accord with the invention.

TABLE I

MT and HAF Blacks In JP-10 Fuel Containing 5% Black

| WT % HAF of Total Black | Stability ($C/C_o$)* | Brookfield Viscosity at 60 rpm (cps) |
|---|---|---|
| None | 0.06 | 26 |
| 5 | 0.13 | 34 |
| 10 | 0.22 | 53 |
| 12.5 | 0.20 | 68 |
| 15 | 0.27 | 84 |
| 17.5 | 0.30 | 111 |
| 20.0 | 0.63 | 162 |
| 22.5 | 0.66 | 201 |

TABLE I-continued

MT and HAF Blacks In JP-10 Fuel Containing 5% Black

| WT % HAF of Total Black | Stability ($C/C_o$)* | Brookfield Viscosity at 60 rpm (cps) |
|---|---|---|
| 25 | 0.40 | 300 |

*C = Black concentration after centrifugation.
$C_o$ = Black concentration before centrifugation.

As can be seen from Table I significantly improved stability is obtained when the weight percent of HAF black in the total amount of black in the fuel is between about 20 to about 23%. As indicated, the composition contained 5% of deflocculant. When the amount of deflocculent (e.g., surfactant) is increased the amount of HAF black may also be increased to achieve the benefit of the invention. Thus, for example, when the above example is carried out with 7.5% of deflocculant present and 25% HAF the stability of the composition is 0.70. From a practical standpoint, much more than about 7.5% deflocculant will not be used because it will tend to reduce the BTU of the final composition. Thus, from about 20 to about 25% of HAF black will be used, preferably about 20 to about 23% when the amount of deflocculant in the fuel composition does not exceed about 5% by weight of the total carbon black.

I claim:

1. A liquid composition suitable as a high density, high performance fuel and having improved rheological and stability properties comprising a liquid hydrocarbon fuel having carbon particles dispersed therein of at least two disparate particle sizes, one of said carbon particles having an average particle diameter of from about 300 to about 350 mu and the other particle having an average particle diameter of about 20 to about 50 mu, said carbon particles of said smaller size being present in an amount between about 20 and about 25 weight percent of said total black.

2. The composition of claim 1 wherein the carbon particles comprise a medium thermal (MT) black and a high abrasion furnace (HAF) black.

3. The composition of claim 2 wherein the fuel is JP-10.

4. A liquid composition suitable as a high performance fuel and having improved rheological and stability properties comprising a liquid hydrocarbon fuel having a density of at least about 0.9 and having carbon particles dispersed therein of at least two disparate particle sizes, one of said carbon particles having an average particle diameter of from about 300 to about 350 mu and the other particle having an average particle diameter of about 20 to about 50 mu, said carbon particles of said smaller size being present in an amount between about 20 and about 25wt.% of said total black, and said fuel containing a stabilizing amount of a surfactant.

5. The composition of claim 4 wherein the carbon particles comprise a medium thermal black and a high abrasion black.

6. The composition of claim 5 wherein the fuel is JP-10 and the total amount of said carbon black is about 50% by weight.

7. The composition of claim 4 wherein the amount of high abrasion black is between about 20 and 23% and the amount of surfactant is about 5% by weight of the total black.

* * * * *

UNITED STATES PATENT OFFICE

CERTIFICATE OF CORRECTION

PATENT NO. : 4,305,729

DATED : December 15, 1981

INVENTOR(S) : Richard S. Stearns

It is certified that error appears in the above-identified patent and that said Letters Patent are hereby corrected as shown below:

Table I, at Column 3, line 56 and Column 4, line 2

Change "5% Black" in each instance to ---50% Black---

Signed and Sealed this

*Twenty-first* Day of *September 1982*

[SEAL]

*Attest:*

GERALD J. MOSSINGHOFF

*Attesting Officer*

*Commissioner of Patents and Trademarks*